US005703478A

United States Patent [19]

Main

[11] Patent Number: 5,703,478

[45] Date of Patent: Dec. 30, 1997

[54] CURRENT MIRROR CIRCUIT

[75] Inventor: William Eric Main, Mesa, Ariz.

[73] Assignee: Motorola, Inc., Schaumburg, Ill.

[21] Appl. No.: 628,307

[22] Filed: Apr. 5, 1996

[51] Int. Cl.[6] ..... G05F 3/04; G05F 3/16

[52] U.S. Cl. ..... 323/315; 327/538

[58] Field of Search ..... 323/315, 313, 323/312, 316, 314; 327/538

[56] References Cited

U.S. PATENT DOCUMENTS

| | | | |
|---|---|---|---|
| 4,654,602 | 3/1987 | Aoki | 323/315 |
| 5,451,859 | 9/1995 | Ryat | 323/312 |
| 5,592,076 | 1/1997 | Main et al. | 323/315 |
| 5,625,282 | 4/1997 | Kawahara | 323/315 |

*Primary Examiner*—Peter S. Wong
*Assistant Examiner*—Rajnikant B. Patel
*Attorney, Agent, or Firm*—Gary W. Hoshizaki

[57] ABSTRACT

A current mirror circuit (31) that includes an active loop which operates transistors of different conductivity type at equal base-emitter junction voltages to minimize error. A first resistor (38) couples to a base of a first transistor (32) of a first conductivity type in a voltage follower configuration. A reference current is coupled to the first resistor (38). The voltage across the first resistor (38) and base-emitter junction of the first transistor (32) is mirrored across the base-emitter junction of a second transistor (34) of a second conductivity type and a second resistor (39). A third transistor (35) of the second conductivity type in a diode configuration is coupled to receive current from the second transistor (34). The voltage across the third transistor (35) biases a fourth transistor (33) of a first conductivity type. The current from the fourth transistor (33) is provided to the first transistor such that the first and second transistors (32,34) operate at equal base-emitter voltages.

19 Claims, 4 Drawing Sheets

-PRIOR ART-

-PRIOR ART-

CURRENT MIRROR CIRCUIT

BACKGROUND OF THE INVENTION

This invention relates, in general, to integrated circuits, and more particularly, to current mirror circuits for producing a current of some multiple of a reference current.

Current mirror circuits are well known to one skilled in the art for providing a current that is a ratio of a reference current. Current mirror circuits use device matching technique to insure an accurate ratio is generated. In general, device geometries in a current mirror circuit are ratioed to achieve a current having a an equal or greater magnitude than the reference current.

FIG. 1 is a prior art diagram of a conventional current mirror 11 that is widely used in linear integrated circuits. Current mirror 11 is implemented using bipolar transistors but is applicable to most field effect transistors (FET) technologies. Current mirror 11 comprises PNP transistors 12, 13, and 14, and a current source 15 providing a reference current Iref. Current mirror 11 includes an output for providing an output current Iout that is some predetermined ratio of the reference current Iref. For illustration purposes assume a beta of transistors 12, 13, and 14 are sufficiently high to minimize any error due to base current.

Transistor 12 is biased by the reference current Iref from current source 15. Transistor 12 produces a reference voltage at a base of transistor 12. The reference voltage is a base-emitter voltage of transistor 12. Transistor 14 provides a current path for base current of transistors 12 and 13 and minimizes base current error of current mirror 11.

Transistor 13 is "mirrored" to transistor 12. In other words, the reference voltage (base-emitter voltage) produced by transistor 12 also biases the base-emitter junction of transistor 13. In the embodiment shown in FIG. 1 the emitter areas of transistors 12 and 13 are ratioed to increase the output of transistor 13. Transistor 12 has an emitter area of A and transistor 13 has an emitter area of NA. The output current Iout is equal to N*Iref since transistor 13 has the same base-emitter voltage as transistor 12. Careful matching of the emitter areas of transistors 12 and 13 can produce an output current that accurately ratios the reference current.

A problem with prior art current mirror 11 is that the technique does not lend itself to producing a ratioed current that is significantly larger than the reference current. For example, making N=5 or N=10 to respectively produce an output current 5*Iref or 10*Iref is within reason since transistor 13 is only ten times larger than transistor 12. Generating an output current one hundred times larger than the reference current, although possible, is typically not done using current mirror 11 due to the large size of transistor 13.

It would be of great benefit if a current mirror could be provided that provides an output current that is accurately ratioed to a reference current over a wide range current of current levels.

DETAILED DESCRIPTION OF THE DRAWINGS

A current mirror circuit provides an output current that is a ratio of a reference current. The accuracy of the ratio between the reference current and the output current is an important factor in the selection of a current mirror circuit. Other factors that play a role in the choice of a current mirror are the physical size of the current mirror circuit and the rate of change in output current due to temperature or voltage.

Figure 1:
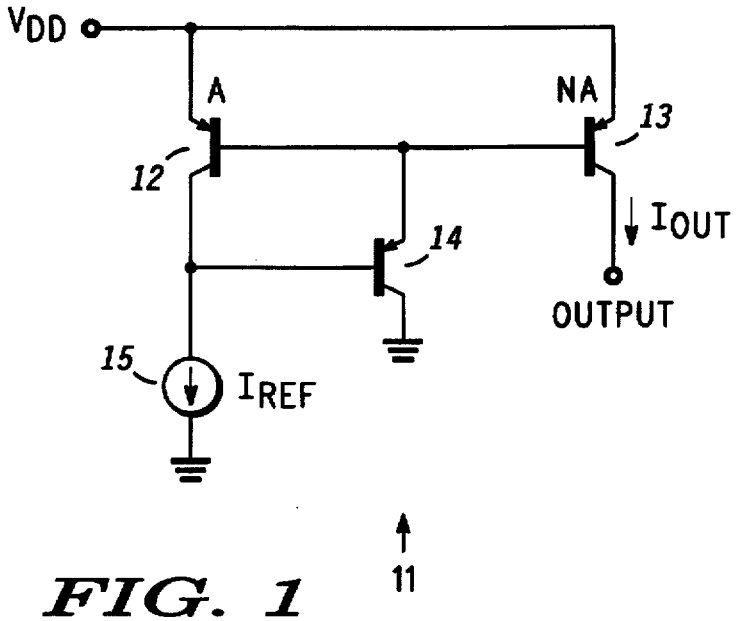
FIG. 1 is a prior art schematic diagram of a current mirror circuit.

Prior art current mirror circuits such as the example shown in FIG. 1 are not suitable for providing an output current that is significantly larger than the reference current because there is a direct correspondence between the size of a device in the current mirror and the ratio of output current to reference current. In other words, increasing output current also increases size of the current mirror circuit.

Figure 2:
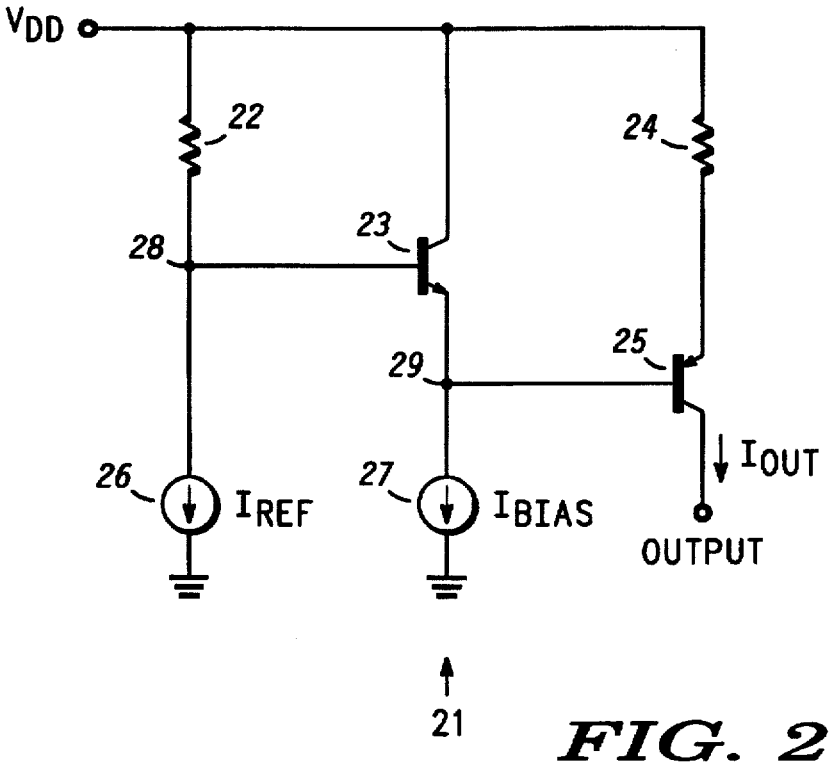
FIG. 2 is a prior art schematic diagram of a current mirror circuit.

FIG. 2 is a prior art schematic diagram of a current mirror 21 that produces an output current proportional to a reference current but does not significantly increase area. Current mirror 21 comprises resistors 22 and 24, transistors 23 and 25, and current sources 26 and 27. Current mirror 21 has an output for providing an output current Iout. Transistors 23 and 25 have a collector, a base, and an emitter respectively corresponding to a first electrode, a control electrode, and a second electrode.

Resistor 22 has a first terminal connected to a first power supply terminal (e.g. VDD) and a second terminal connected to a node 28. Current source 26 provides a reference current Iref to generate a voltage across resistor 22. Current source 26 has a first terminal connected to node 28 and a second terminal connected to a second power supply terminal (e.g. GND).

Transistor 23 is a NPN transistor in a voltage follower configuration. Transistor 23 has a collector connected to VDD, a base connected to node 28, and an emitter connected to a node 29. Current source 27 provides a bias current to transistor 23. Current source 27 has a first terminal connected to node 29 and a second terminal connected to GND.

Transistor 25 provides the output current Iout. Transistor 25 is a PNP transistor having a collector connected to the output of current mirror 21, a base connected to node 29, and an emitter. Resistor 24 has a first terminal connected to the emitter of transistor 25 and a second terminal connected to VDD.

Reference current Iref produces a voltage drop across resistor 22 (R22) which is described by equation 1.

$$V(R22)=Iref*R22 \quad (1)$$

The base-emitter voltage (Vbe) of transistor 23 (T23) is described by equation 2.

$$Vbe(T23)=Vt*ln(Ibias/Isn) \quad (2)$$

Vt is the thermal voltage (kT/q) where k is Boltzmann's constant, T is absolute temperature, and q is the charge of an electron. Isn is the saturation current for a NPN transistor. A value of Isn is a function of the semiconductor wafer process and the conductive area of transistor 23. A reference voltage at node 29 is generated comprising a voltage drop across resistor 22 and a base-emitter junction voltage of transistor 23.

The voltage across the base-emitter junction of transistor 25 and resistor 24 is equal to the voltage across the base-emitter junction of transistor 23 and resistor 22. The base-emitter junction voltages of transistors 23 and 25 are not equal due to differences in operating conditions and the fact that transistors 23 and 25 are opposite types (NPN and PNP). Thus, the voltage across resistors 22 and 24 are not equal. The difference between the base-emitter junction voltages of transistors 23 and 24 produce an error when compared to the ideal case. The ideal case occurs when the base-emitter junction voltages of transistors 23 and 25 are equal. Under this condition the voltage across resistor 22 (R22) is equal to the voltage across resistor 24 (R24). The output current Iout is then defined by equation 3.

$$Iout=(Iref*R22)/R24 \quad (3)$$

Thus, the output current Iout is determined by ratioing the size of resistor 24 to resistor 22. This is ideal because a device ratio can be accurately achieved in an integrated circuit wafer process as is well known. An example which produces an output current Iout one hundred times larger than the reference current Iref in the ideal case would require the resistance of resistor 24 to be one hundredth of the resistor value of resistor 22.

In practice, current mirror 21 does not exactly produce the desired ratio between the output current Iout and Iref. The error due to the difference in base-emitter junction voltages of transistors 23 and 25 is reduced when a high current ratio is generated. The error is minimized due to the voltage across resistors 22 and 24 being significantly larger than the difference in base-emitter junction voltage (dVbe) of transistors 23 and 25 which is typical to a high current ratio. In other words, the base-emitter junction voltage difference is designed to be a small percentage of the voltage across resistor 24. The current provided by transistor 25 is defined by equation 4.

$$Iout=((Iref*R22)-dVbe)/R24 \quad (4)$$

If dVbe/R24 is small in comparison to (Iref*R22)/R24 the error due to base-emitter junction voltage difference is small. For example, assume transistor 25 operates having a base-emitter junction voltage 100 millivolts greater than a base-emitter junction voltage of transistor 23. Also, assume voltage across resistor 22 is one volt. The voltage across resistor 24 is 900 millivolts instead of one volt (ideal case) producing a 10 percent error in the output current ratio.

Conversely, current mirror 21 will have significant error at low currents. Operation at low currents reduces the voltage across resistors 22 and 24. Thus, the dVbe/R24 term of equation 24 becomes a significant factor in reducing the output current Iout from the expected ratio as described in equation 3.

Figure 3:
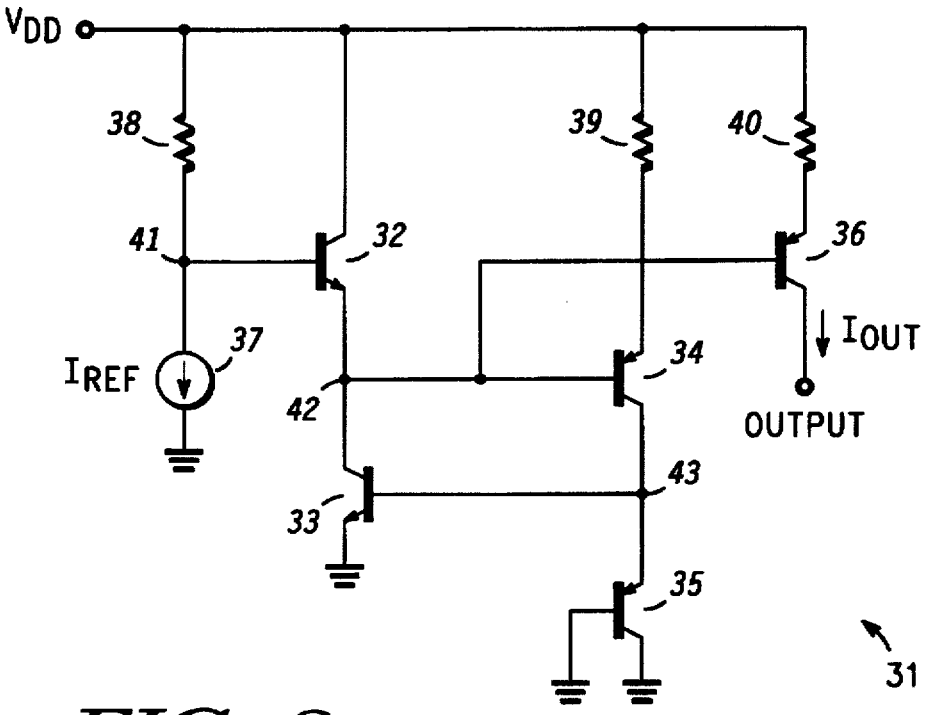
FIG. 3 is a schematic diagram of a current mirror circuit in accordance with the present invention.

FIG. 3 is a current mirror circuit 31 that provides an accurate current ratio between a reference current Iref and an output current Iout over a wide range of values in accordance with the present invention. The method used to increase accuracy biases transistors of different conductivity type (for example, NPN and PNP transistors) to operate having the same base-emitter junction voltage. Operating the dissimilar transistor types at the same base-emitter voltage reduces current mirror error and makes the relationship between an output current and a reference current of a current mirror a simple resistor ratio.

Current mirror 31 comprises transistors 32, 33, 34, 35, and 36, resistors 38, 39, and 40, and a current source 37. Current mirror has an output for providing the output current Iout. Transistors 32–36 have a collector, a base, and an emitter respectively corresponding to a first electrode, a control electrode, and a second electrode. Transistors 32 and 34 are transistors of opposite type that operate having the same base-emitter voltage.

Resistor 38 has a first terminal connected to a power supply terminal (e.g. VDD) and a second terminal connected to a node 41. Current source 37 provides a current Iref to generate a voltage across resistor 38. Current source 37 has a first terminal connected to node 41 and a second terminal connected to a power supply terminal (e.g. GND). Transistor 32 is in a voltage follower configuration. Transistor 32 is a NPN transistor having a collector connected to VDD, a base connected to node 41, and an emitter connected to a node 42.

Transistor 34 is a PNP transistor having a collector connected to a node 43, a base connected to node 42, and an emitter. Resistor 39 has a first terminal connected to VDD and a second terminal connected to the emitter of transistor 34. The voltage across resistor 38 and a base-emitter junction voltage of transistor 32 is equal to the voltage across resistor 39 and a base-emitter junction voltage of transistor 34. Transistors 32 and 34 are transistors of current mirror 31 of different conductivity type.

Transistors 33 and 35 force the base-emitter junction voltages of transistors 32 and 34 to be equal. Transistor 35 is in a diode configuration. Transistor 35 is a PNP transistor having a collector and a base connected to ground, and an emitter connected to node 43. Transistor 33 provides bias current to transistor 32. Transistor 33 is a NPN transistor having a collector connected to node 42, a base connected to node 43, and an emitter connected to ground.

Transistor 36 provides the output current for current mirror 31. Transistor 36 is a PNP transistor having a collector connected to the output of current mirror 31, a base connected to node 42, and an emitter. Resistor 40 has a first terminal connected to VDD and a second terminal connected to the emitter of transistor 36. The voltage across resistor 39 and the base-emitter junction voltage of transistor 34 is equal to the voltage across resistor 40 and the base-emitter junction voltage of transistor 36.

As mentioned previously, current source 37 generates a voltage drop across resistor 38 (R38) that is equal to Iref*R38. For illustration purposes, assume the device geometry of transistor 32 equals transistor 33 and the device geometry of transistor 34 equal transistor 35. Current from transistor 34 generates a voltage across transistor 35 in the diode configuration. The emitter-base voltage of PNP transistor 35 biases the base-emitter voltage of transistor 33. In particular, the magnitude of the base-emitter junction voltages of transistors 33 and 35 are equal. A current generated by transistor 33 biases transistor 32. The currents conducted by transistors 35 and 33 are typically not equal due to difference in device type. An active loop is formed by transistors 32–35 which stabilizes the voltage at node 42 corresponding to the condition when the base-emitter voltages of transistors 32–35 are equal. The output current corresponds to the current conducted by transistor 34. The current magnitude is increased by ratioing resistor 40 to resistor 39 and transistor 36 to transistor 34.

An example best illustrates operation of current mirror 31. In this example, Iref=1 microampere (ua), resistor 38=100 kilo-ohms, and Iout=100 microamperes, thus current mirror 31 provides a hundredfold increase in current (Iout/Iref). Transistors 32–36 are minimum geometry transistors. Transistor 32 is matched to transistor 33. Similarly, transistor 34 is matched to transistor 35. Transistor 34 conducts 10 microamperes (ten times the reference current Iref) to reduce ratioing of transistor 36. The voltage across resistor 38 (R38) equals the voltage across resistor 39 (R39) since the base-emitter junction voltages of transistors 32 and 34 are equal. The current of transistor 34 (T34) is defined by equation 5.

$$I(T34)=Iref*(R38/R39) \quad (5)$$

Rearranging equation 5 and solving for R39 yields a value of 10 kilo-ohms for resistor 39. As mentioned previously, transistors 32 typically does not operate at the same current as transistor 34 to generate equal base-emitter voltages. The current conducted by transistor 32 (T32) is calculated from equation 6.

$$I(T32)=(Isn)*(I(T34)/Isp) \quad (6)$$

Isp and Isn are respectively the saturation currents of PNP transistor 34 and NPN transistor 32. Isp and Isn are a function of wafer processing and device geometry. For example, if Isn/Isp=1.5, transistor 32 conducts 15 microamperes to generate the same base-emitter junction voltage as transistor 34.

The output current Iout=100 microamperes is ten times the current conducted by transistor 34. The device geometry of transistor 36 is made ten times larger than the minimum geometry of transistor 34 to operate at the current density. Thus, the voltage across resistor 39 is equal to the voltage across resistor 40. Resistor 40 (R40) is made one tenth the value of resistor 39 (R40=1 kilo-ohm) to produce the tenfold increase in current at the output.

The active loop formed by transistors 32–35 has a loop gain of approximately one. Current mirror 31 starts up and stabilizes via leakage current if the loop gain is one or greater. Conversely, a loop gain less than one allows a complete shutdown of the circuit when current mirror 31 is turned off. In an embodiment, of current mirror 31 the loop gain is deliberately made less than one to insure complete shut down. The loop gain is forced to be less than one by varying the conductive areas A32, A33, A34, and A35 (emitter areas) respectively of transistors 32–35 to meet equation 7.

$$A32*A35<A34*A33 \quad (7)$$

An example which would benefit from this deliberate mismatch would be a battery operated circuit using current mirror 31 which is turned on and off. Ratioing the transistor areas to insure shut down will conserve power of the battery operated circuit. For example, making transistor 32 have twice the area of transistor 33 produces an 18 millivolt difference in base-emitter junction voltages of transistors 32 and 34. The increased area of transistor 32 insures shut down of current mirror 31 when the current Iref is removed. The 18 millivolt difference in base-emitter junction voltage produces an error in the current ratio between the currents Iout/Iref.

Figure 4:
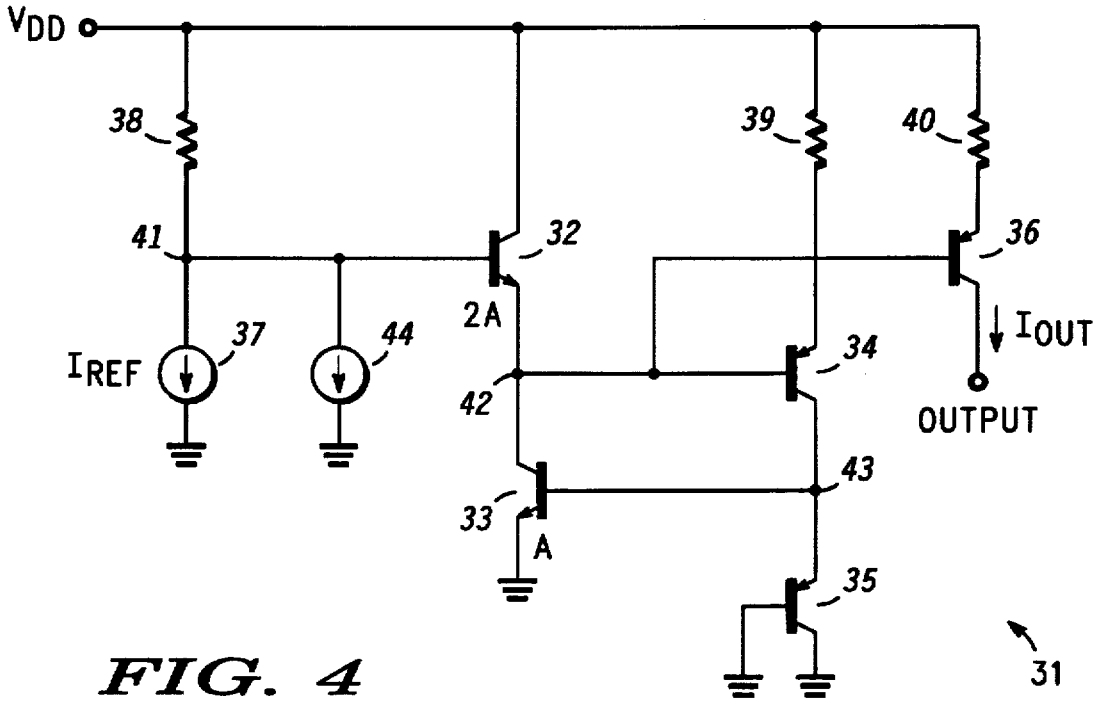
FIG. 4 is a schematic diagram of the current mirror of FIG. 3 including offset circuitry in accordance with the present invention.

FIG. 4 is a schematic diagram of current mirror circuit 31 including offset circuitry. In general, a conductive area (emitter area) of transistor 32 is made larger than transistor 33 to make the loop gain less than one. For example, transistor 33 has an emitter area A. Transistor 32 has an emitter area 2A which insures shut down of current mirror 31. Increasing the area of transistor 32 operates transistor 32 having a base-emitter junction voltage 18 millivolts smaller than the base-emitter junction voltage of transistor 34. The same result could be achieved by making transistor 35 have twice the conductive area of transistor 34.

An offset circuit comprising a current source 44 is added to current mirror 31 to increase the voltage across resistor 38 by 18 millivolts. The voltage across resistor 38 is increased by 18 millivolts to compensate for the reduction in base-emitter voltage due to the emitter area of transistors 32 being twice the area of transistor 34. A current provided by current source 44 times the resistance of resistor 38 equals 18 millivolts. Increasing the voltage across resistor 38 by 18 millivolts produces the correct ratio of output current to reference current while insuring the active loop comprising transistors 32–35 shuts down.

Figure 5:
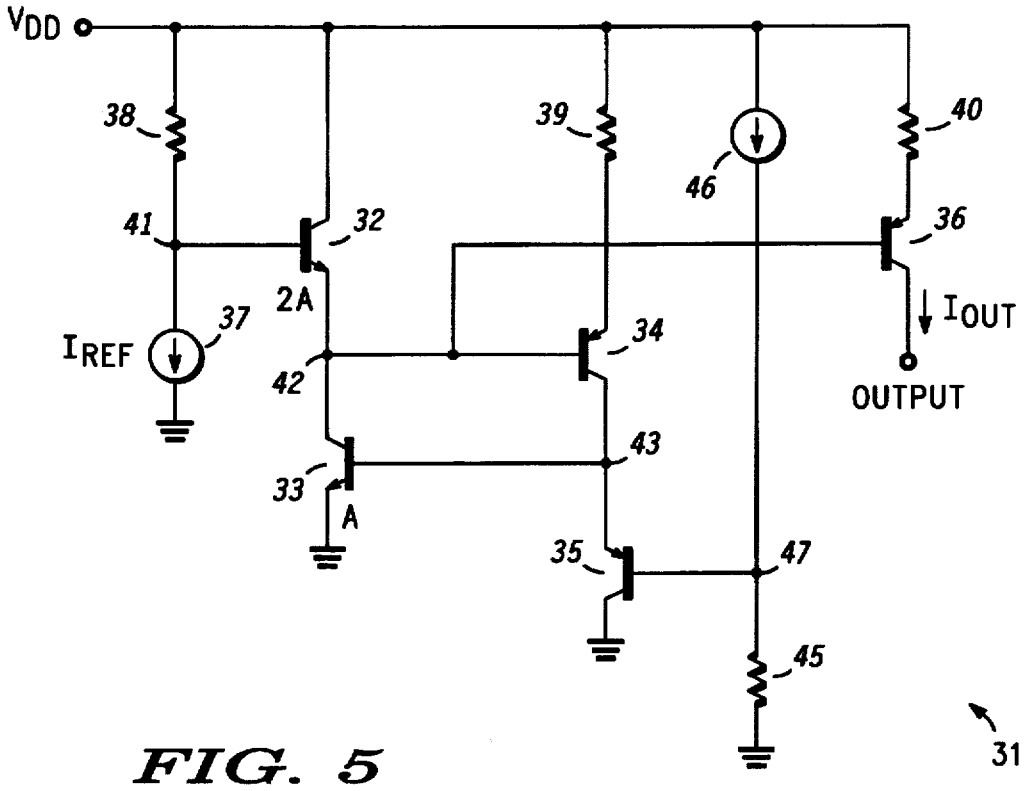
FIG. 5 is a schematic diagram of the current mirror of FIG. 3 including offset circuitry in accordance with the present invention.

FIG. 5 is a schematic diagram of current mirror 31 including offset circuitry. Transistor 33 has an emitter area A. Transistor 32 has an emitter area 2A which insures shut down of current mirror 31. Increasing the area of transistor 32 operates transistor 32 having a base-emitter junction voltage 18 millivolts smaller than a base-emitter junction voltage of transistor 33. An offset circuit comprises current source 46 and resistor 45. Current source 46 has a first terminal connected to VDD and a second terminal connected to a node 47. Resistor 45 has a first terminal connected to node 47 and a second terminal connected to ground.

Referring to FIG. 3 the base of transistor 35 is connected to ground. Referring back to FIG. 5 resistor 45 is connected between the base of transistor 35 and ground. Current source 46 provides a current that generates an 18 millivolt voltage across resistor 45. Thus, the voltage at node 43 is increased by 18 millivolts which increases the current provided by transistor 33. The increase in current from transistor 33 increases the base-emitter voltage of transistor 32 by 18 millivolts thereby compensating for the mismatch in transistor areas between transistors 32 and 33.

Figure 6:
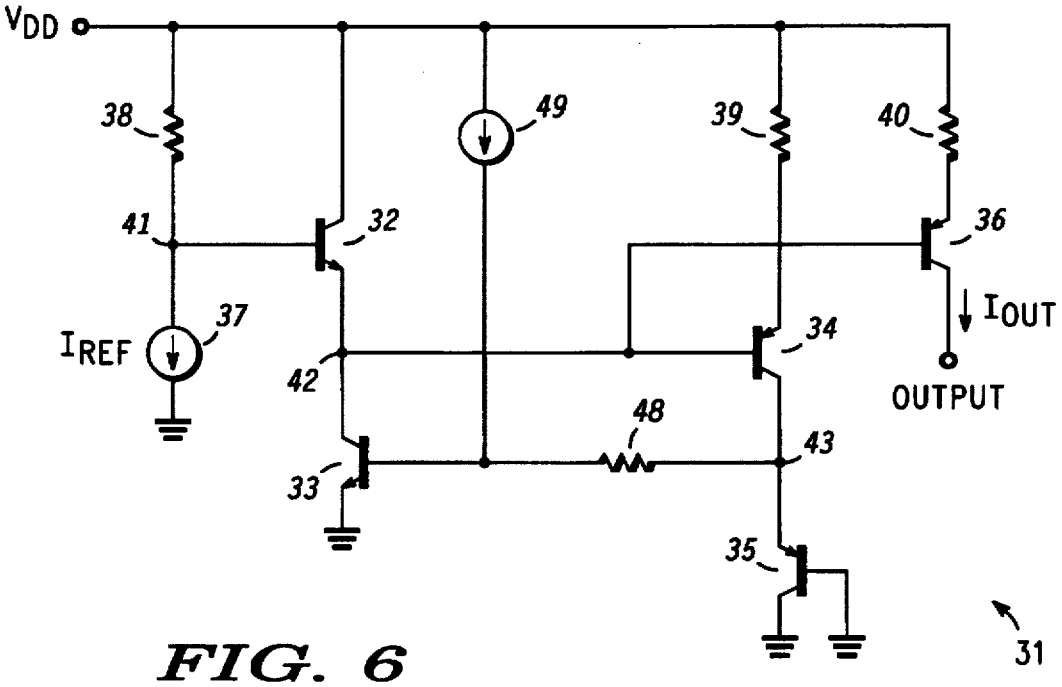
FIG. 6 is a schematic diagram of the current mirror of FIG. 3 including a startup circuit for rapidly stabilizing the active loop in accordance with the present invention.

FIG. 6 is a schematic diagram of current mirror 31 including a startup circuit to speed up the active loop reaching a stable condition. In some applications it may be important for current mirror 31 to provide the output current Iout as rapidly as possible. The startup circuit includes a resistor 48 and a current source 49. Resistor 48 has a first terminal connected to the base of transistor 33 and a second terminal connected to node 43. Current source 49 has a control terminal for receiving a power on reset signal, a first terminal connected to VDD, and a second terminal connected to the base of transistor 33. Current mirror 31 is not reliant on leakage current to start up the circuit.

Upon powering up current mirror 31, the power on reset signal turns on current source 49. Current source 49 provides current for enabling both transistors 33 and 35. Once transistor 33 is conducting current the active loop (transistors 32–35) rapidly converges to a stable condition where the base-emitter junction voltages of transistors 32 and 34 are equal.

Resistor 38 is an alternative configuration to produce an increase in voltage to compensate for offset added to current mirror circuit 31 to insure shut down similar to that described in FIGS. 4 and 5.

Figure 7:
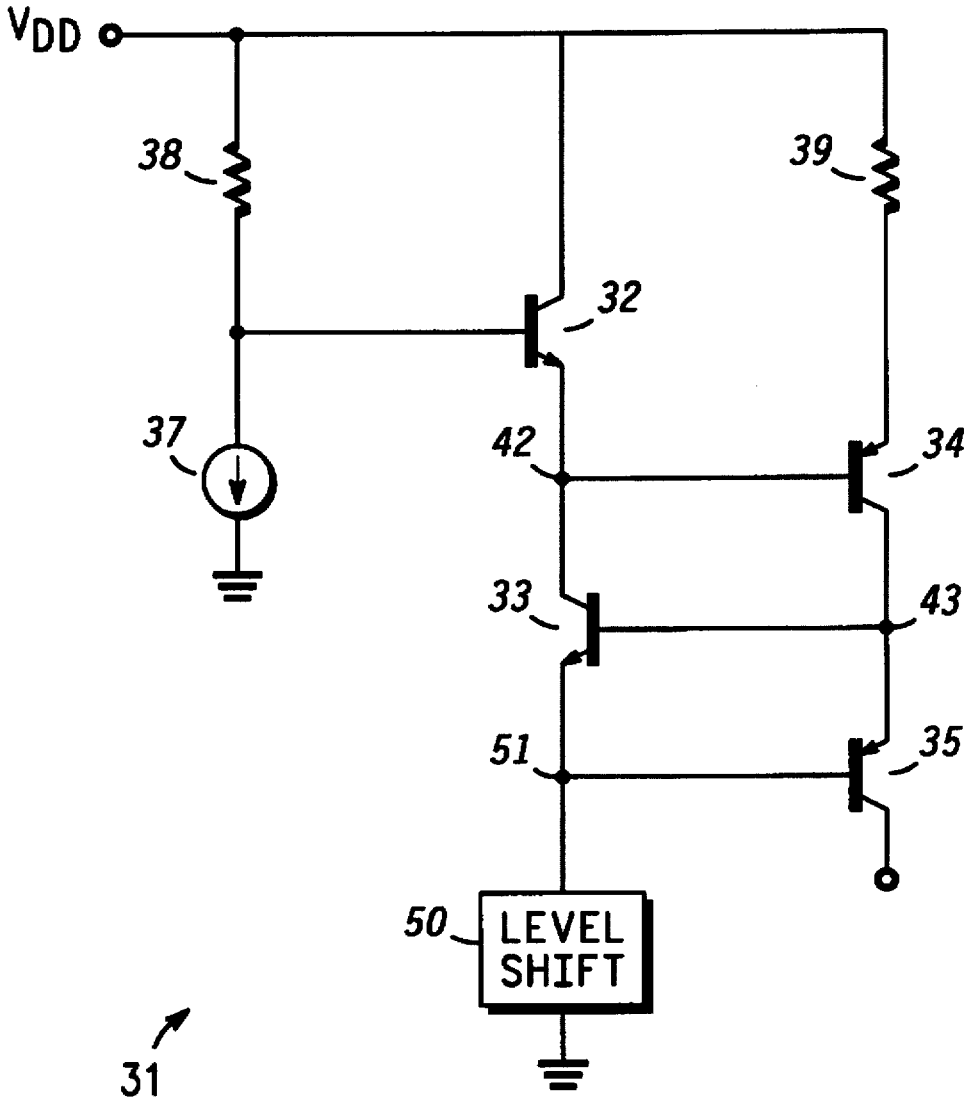
FIG. 7 is a schematic diagram of an alternate embodiment of the current mirror of FIG. 3 in accordance with the present invention.

FIG. 7 is a schematic diagram of an alternate embodiment of current mirror 31. In particular, the output stage comprising transistor 36 and resistor 40 as shown in FIG. 3 is eliminated to reduce device count of current mirror 31. Transistor 35 provides the output current of current mirror 31. Referring to FIG. 3, the collector of transistor 35 and the emitter of transistor 33 is connected to ground. Referring back to FIG. 7, the collector of transistor 35 is connected to the output of current mirror 31. The emitter of transistor 33 is connected to a node 51. A level shift circuit 50 is connected between node 51 and ground.

Level shift circuit 50 increases a voltage at node 43 to provide operating room for a circuit to be coupled between the output of current mirror 31 and ground. An example of level shift circuit 50 are series coupled diodes or a resistor.

By now it should be appreciated that a current mirror circuit has been provided that provides an output current that accurately ratios to a reference current over all operating conditions. The current mirror circuit operates transistors of different conductivity type having the same base-emitter junction voltage. The ratio between the reference current and the output current is then a simple resistor ratio. The transistors of different conductivity type are operated at the same base-emitter junction voltage by forming an active loop. A current from a first transistor of a first conductivity type biases a second transistor of the first conductivity type to generate a base-emitter reference voltage. The base-emitter reference voltage biases a third transistor of a second conductivity type which generates a current corresponding to the base-emitter reference voltage. The current of the third transistor biases a fourth transistor of the second conductivity type thereby generating a base-emitter voltage on the fourth transistor that corresponds to the base-emitter junction voltage of the first transistor.

While specific embodiments of the present invention have been shown and described, further modifications and improvements will occur to those skilled in the art. It is understood that the invention is not limited to the particular forms shown and it is intended for the appended claims to cover all modifications which do not depart from the spirit and scope of this invention.

I claim:

1. A current mirror having an input for receiving a reference current and an output for providing an output current, the current mirror comprising:

a first resistor having a first terminal coupled to a first power supply terminal and a second terminal coupled to the input of the current mirror;

a first transistor of a first conductivity type having a first electrode coupled to said first power supply terminal, a control electrode coupled to the input of the current mirror, and a second electrode;

a second transistor of a second conductivity type having a first electrode, a control electrode coupled to said second electrode of said first transistor, and a second electrode;

a second resistor having a first terminal coupled to said second electrode of said second transistor and a second terminal coupled to said first power supply terminal;

a third transistor of said first conductivity type having a first electrode coupled to said second electrode of said first transistor, a control electrode coupled to said first electrode of said second transistor, and a second electrode coupled to a second power supply terminal; and a fourth transistor of said second conductivity type having a first electrode coupled to said second power supply terminal, a control electrode coupled to said second power supply terminal, and a second electrode coupled to said first electrode of said second transistor.

2. The current mirror as recited in claim 1 wherein said second and fourth transistors have equal size.

3. The current mirror as recited in claim 2 wherein said first and third transistor have equal size.

4. The current mirror as recited in claim 3 wherein said first and second transistors have equal base-emitter junction voltages and wherein a current conducted by said second transistor corresponds to a ratio of a resistance of said second resistor to a resistance of said first resistor.

5. The current mirror as recited in claim 4 further including:

a fifth transistor of said second conductivity type having a first electrode coupled to the output of the current mirror, a control electrode coupled to said second electrode of said first transistor, and a second electrode; and a third resistor having a first terminal coupled to said second electrode of said first transistor and a second terminal coupled to said first power supply terminal.

6. The current mirror as recited in claim 5 wherein a ratio of a conductive area of said fifth transistor to a conductive area of said second transistor equals a ratio of said resistance of said second resistor to a resistance of said third resistor.

7. The current mirror as recited in claim 3 wherein a conductive area of said first transistor is larger than a conductive area of said third transistor to insure an active loop comprising said first, second, third, and fourth transistors shuts down when the reference current is not provided to the current mirror.

8. The current mirror as recited in claim 7 further including a current source between the input of the current mirror and said second power supply terminal for increasing a voltage across said first resistor to compensate for a base-emitter junction voltage of said first transistor.

9. The current mirror as recited in claim 7 further including:

a resistor coupled between said control electrode of said fourth transistor and said second power supply terminal; and a current source coupled between said first power supply terminal and said control electrode of said fourth transistor.

10. The current mirror as recited in claim 7 further including a resistor coupled between said control electrode of said third transistor and said second electrode of said fourth transistor.

11. The current mirror as recited in claim 10 further including a current source coupled between said first power supply terminal and said control electrode of said third transistor to start up the current mirror.

12. A method of increasing accuracy of a current mirror wherein the current mirror comprises transistors of different conductivity type, the method including a step of operating the transistors of different conductivity type having identical base-emitter junction voltages to minimize current mirror error.

13. The method as recited in claim 12 further including the steps of:

providing a current from a first transistor of a first conductivity type to a second transistor of said first conductivity type; and generating a reference voltage corresponding to a base-emitter junction voltage of said second transistor wherein said second transistor is biased with said current from said first transistor.

14. The method as recited in claim 13 further including a step of biasing a base-emitter junction of a third transistor of a second conductivity type with said reference voltage.

15. The method as recited in claim 14 further including a step of providing a current from said third transistor to bias a fourth transistor of said second conductivity type.

16. The method as recited in claim 14 further including the steps of:

matching a conductive area of said first and second transistors; and matching a conductive area of said third and fourth transistors wherein a base-emitter voltage of said first, second, third, and fourth transistors are equal.

17. A current mirror having an input for receiving a reference current and an output for providing an output current, the current mirror comprising:

a first resistor having a first terminal coupled to a first power supply terminal and a second terminal coupled to the input of the current mirror;

a first transistor of a first conductivity type having a first electrode coupled to said first power supply terminal, a control electrode coupled to the input of the current mirror, and a second electrode;

a second transistor of a second conductivity type having a first electrode, a control electrode coupled to said second electrode of said first transistor, and a second electrode;

second resistor having a first terminal coupled to said second electrode of said second transistor and a second terminal coupled to said first power supply terminal;

a third transistor of said first conductivity type having a first electrode coupled to said second electrode of said first transistor, a control electrode coupled to said first electrode of said second transistor, and a second electrode coupled to a second power supply terminal;

a fourth transistor of said second conductivity type having a first electrode coupled to said second power supply terminal, a control electrode coupled to said second power supply terminal, and a second electrode coupled to said first electrode of said second transistor;

a fifth transistor of said second conductivity type having a first electrode coupled to the output of the current mirror, a control electrode coupled to said second electrode of said first transistor, and a second electrode; and a third resistor having a first terminal coupled to said second electrode of said first transistor and a second terminal coupled to said first power supply terminal.

18. A current mirror having an input for receiving a reference current and an output for providing an output current, the current mirror comprising:

a first resistor having a first terminal coupled to a first power supply terminal and a second terminal coupled to the input of the current mirror;

a first transistor of a first conductivity type having a first electrode coupled to said first power supply terminal, a control electrode coupled to the input of the current mirror, and a second electrode;

a second transistor of a second conductivity type having a first electrode, a control electrode coupled to said second electrode of said first transistor, and a second electrode;

a second resistor having a first terminal coupled to said second electrode of said second transistor and a second terminal coupled to said first power supply terminal;

a third transistor of said first conductivity type having a first electrode coupled to said second electrode of said first transistor, a control electrode coupled to said first electrode of said second transistor, and a second electrode coupled to a second power supply terminal; and a fourth transistor of said second conductivity type having a first electrode coupled to the output of the current mirror, a control electrode coupled to said second electrode of said third transistor, and a second electrode coupled to said first electrode of said second transistor.

19. The current mirror as recited in claim 18 further including a level shift circuit coupled between said second electrode of said third transistor and said second power supply terminal.

* * * * *